US005251905A

United States Patent [19]

Bombino

[11] Patent Number: 5,251,905

[45] Date of Patent: Oct. 12, 1993

[54] METHOD FOR PLAYING WAR GAME

[76] Inventor: Angel Bombino, 235 S.W. LeJeune Rd., Miami, Fla. 33134

[21] Appl. No.: 847,539

[22] Filed: Mar. 6, 1992

Related U.S. Application Data

[62] Division of Ser. No. 689,210, Apr. 22, 1991, abandoned.

[51] Int. Cl.[5] ..... A63F 3/00

[52] U.S. Cl. ..... 273/255

[58] Field of Search ..... 273/242, 243, 255, 262, 273/265

[56] References Cited

U.S. PATENT DOCUMENTS

| | | | |
|---|---|---|---|
| 972,382 | 10/1910 | Johnson | 273/255 |
| 2,273,292 | 2/1942 | Smith | 273/255 |
| 2,310,686 | 2/1943 | Freer | 273/255 |
| 3,998,463 | 12/1976 | Zumchak | 273/262 |
| 4,753,441 | 6/1988 | Braus | 273/255 |
| 4,982,965 | 1/1991 | Dozorsky | 273/262 |

FOREIGN PATENT DOCUMENTS

| | | | |
|---|---|---|---|
| 908764 | 4/1946 | France | 273/255 |
| 1117689 | 5/1956 | France | 273/255 |

*Primary Examiner*—William Stoll

[57] ABSTRACT

A method for playing a war board game that includes a plurality of contiguously arranged square spaces that represent two land areas and one sea area separating the first two. There are four classes of tokens: tanks, battleships, airplanes and a command center. Each player receives initially a set of these tokens which, in conjunction with a set of dice, move and direct their firepower over the board. The tanks are limited in their travel to land, the battleships to the sea while the airplanes have no limitations. The command center does not have firepower and the object is to hit it thereby destroying it. The ultimate goal is to destroy the different pieces that come within their firepower.

4 Claims, 1 Drawing Sheet

METHOD FOR PLAYING WAR GAME

This is a division of application Ser. No. 07/689,210, filed on Apr. 22, 1991, now abandoned.

BACKGROUND OF THE INVENTION

Field of the Invention

The present invention relates to a method for playing a war game, and more particularly, to such games that include the use of dice and tokens representing ships, tanks and planes.

SUMMARY OF THE INVENTION

It is one of the main objects of the present invention to provide a board game that simulates the tactical movement of war represented by ships, planes and tanks along predetermined paths and in certain cooperative interaction through a plurality of rules.

It is yet another object of this present invention to provide such a game that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
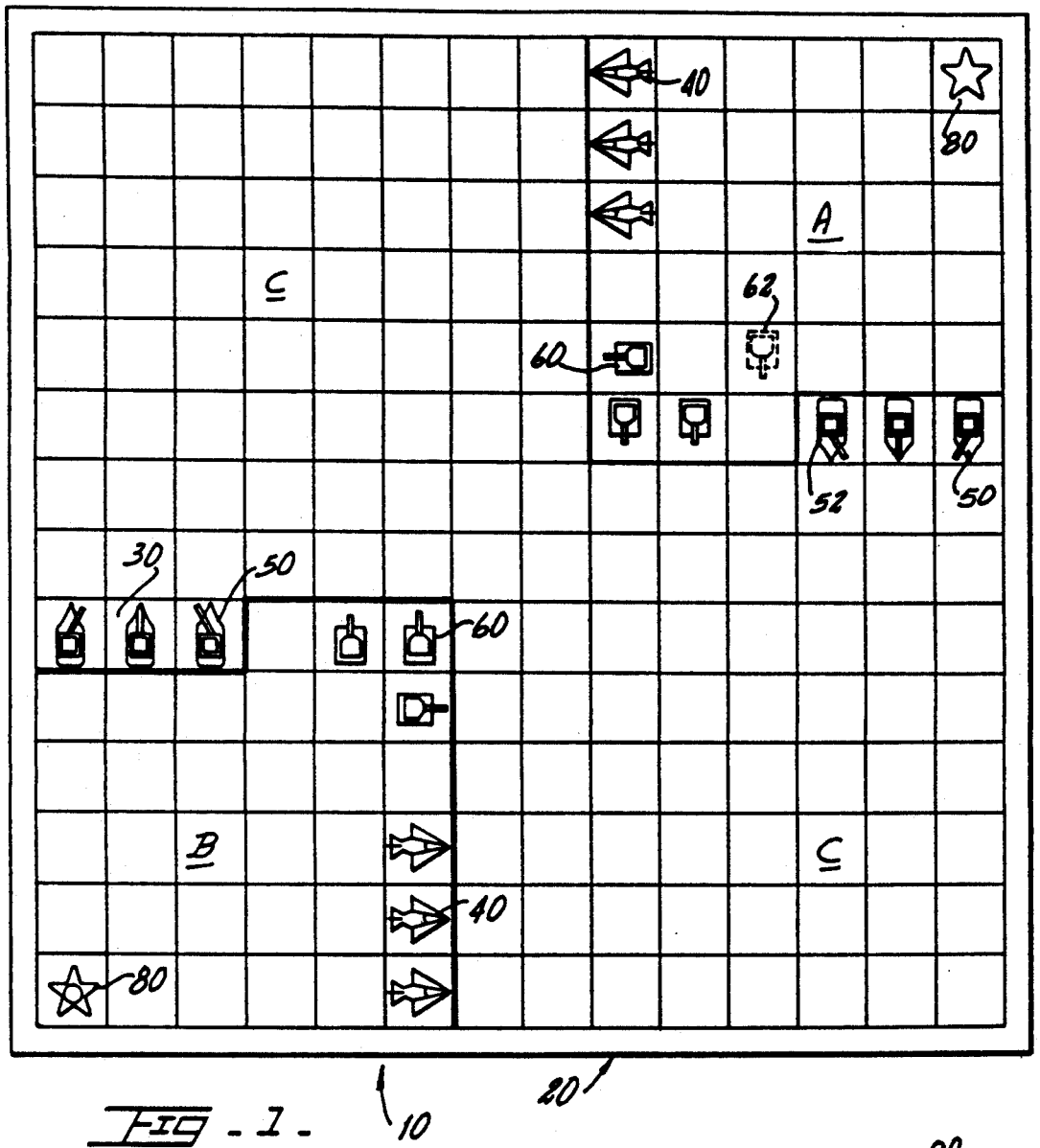
FIG. 1 represents the board used in one of the preferred embodiments of the present invention.
Figure 2:
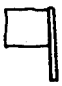
FIG. 2 shows the dice used in the present invention.
Figure 2:
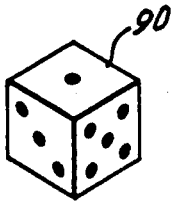
Figure 3:
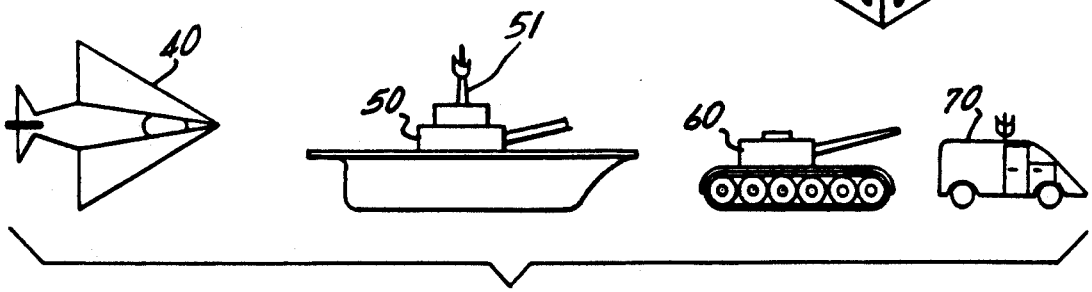
FIG. 3 illustrates the tokens used in the present invention, representing tanks, planes, ships and the command center.

Referring now to the drawings, where the board game in the present invention is generally referred to with numeral 10, it can be observed that it basically includes game board 20 that includes four sides forming a square with fourteen square spaces per side making a total of one hundred and ninety six squares. There are two groups of squares A and B on the board wherein the squares represent land and a third group C of squares representing the sea separating the two above-mentioned land areas. The land areas can take any configuration. The preferred embodiment is shown with a bay coastal configuration 30.

The tokens used in preferred embodiment include three planes 40, three battleships 50, three tanks 60, and one command center 70 for each player. These tokens are shown within the initial configuration in FIG. 1 with solid lines. Command center 70 for each player is initially placed on square 80. The two dice (one of them represented with numeral 90) cast two numbers that can each be used to either advance the token or direct its firepower and the player decides which die will be for advancing and which one for firing. Both, advancing and firing follow paths that are perpendicular to the sides of the board. Tanks 60 can only advance within the areas denominated as land areas (A and B). Battleships 50 can only advance in the sea area (C) and planes

40 can advance all over the board 20. The tokens can not advance over another token. The tokens can go along those above-mentioned perpendicular paths in all directions. The same is true for directing their firepower, i.e., if a player casts a five and an enemy token is that many spaces away he or she will not be able to destroy it if another token (friend or foe) is in between. There are no restrictions with respect to the numbers on the die and the type of token. The firing only strikes the space rolled and nothing in between. As mentioned above, if another token is in the path, then the firing or possible advance is blocked.

Command center 70 for each player is land bound and it does not have any fire power capabilities. If exposed to enemy fire and hit, the player loses the game. Also, due to the reduced physical area in the land area, it is impossible for the command center to use all the numbers cast. For instance, the maximum number of squares in the land area is "five" so if a player casts a 6 (six), then he or she has to use another token to move.

The ultimate goal is to destroy the command center 70 of the opposite player. In the process, the players will destroy the different pieces that come within their firepower. A player may protect his or her tokens by aligning two or more of them diagonally, as shown in FIG. 1 with tokens 52 and 62.

Another characteristic of the sea bound tokens, such as the battleships 50, is that they can successfully arrive at the enemy's land area and disembark an additional tank 60 in an empty square. They disembark one land force represented with a tank token 60, with the consequent benefit of bringing enemy's command center 70 within the firepower reach of its force. Each player can disembark up to three tanks 60 in addition to those being assigned initially. Each battleship 50 may carry removable flag 51 to indicate that it has disembarked a tank 60 already. Battleships 50 can only disembark one tank 60 each.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A method for playing a game with two players comprising the steps of:

A. providing a board member having a plurality of contiguous square spaces defining rows and columns, perpendicular to each other, and said square spaces further defining three areas, two of said areas being denominated as land areas and the third area being denominated as sea area that separates the first two;

B. providing each player with a set of a predetermined number of token means representing planes, battleships and tanks, and each player also being provided with one command center token;

C. positioning on said board, at the outset, said token means representing command center, planes and tanks within said land area;

D. positioning on said board, at the outset, said token means representing battleships within said sea area adjacent to said land area;

E. designating movement capabilities for each one of said token means in conjunction with means for generating random numbers corresponding to spaces for the token means to be moved so that said token means that represent said command center and tanks are bound to move along the land areas, those that represent battleships are bound to the sea area and the ones that represent planes are not restricted in their movement along the entire board;

F. designating firing capabilities for each one of said token means in conjunction with means for generating random numbers corresponding to the spaces for said firing capabilities;

G. each player taking turns in operating said means for generating random numbers, moving said token means and firing them against the opposite player's token means; and H. winning the game when one of said players hits the other player's command center.

2. The method set forth in claim 1 wherein said predetermined number of token means consists of three planes, three battleships and three tanks.

3. The method set forth in claim 2 wherein said land area has a number of spaces that is smaller than the maximum number that can be obtained with said means for generating random numbers.

4. The method set forth in claim 3 wherein said means for generating random numbers includes at least one die.

* * * * *